United States Patent [19]

Garriga

[11] Patent Number: 4,526,660

[45] Date of Patent: Jul. 2, 1985

[54] ANODIZING METHOD

[76] Inventor: Eliseo B. Garriga, Pradera No. 10, Pedregal de San Angel, Mexico

[21] Appl. No.: 623,790

[22] Filed: Jun. 22, 1984

[30] Foreign Application Priority Data

Feb. 6, 1984 [MX] Mexico ..... 200240

[51] Int. Cl.[3] ..... C25D 11/08; C25D 11/10

[52] U.S. Cl. ..... 204/58

[58] Field of Search ..... 204/58

[56] References Cited

U.S. PATENT DOCUMENTS 2,166,180 7/1939 Ruben ..... 204/58

2,578,400 12/1951 Cohn ..... 204/58

OTHER PUBLICATIONS

Handbook of Chem. & Physics, pp. 916–917.

*Primary Examiner*—R. L. Andrews

*Attorney, Agent, or Firm*—McGlew and Tuttle

[57] ABSTRACT

An anodizing process or more particularly an anodic oxdiation of aluminum is effected by means of an electrolyte of low dissolving power, high efficiency, and lost cost.

8 Claims, 3 Drawing Figures

ANODIZING METHOD

BACKGROUND OF THE INVENTION

Field of the Invention

This invention relates, in general, to an electrolytic process and, in particular, to a new and useful anodizing process which comprises an anodic oxidation of aluminum by means of an electrolyte of low dissolving power.

Anodizing is, as is known, an electrolytic process in use for some years, whereby a surface layer of oxide is formed, by the passage of an electric current in an acid electrolyte, using aluminum as the anode.

In the conventional anodizing processes, electrolytes of sulfuric acid have been used whose concentration varies between 180 and 240 g/ltr.

Likewise processes are known which use as electrolytes mixtures of sulfuric acid and oxalic acid, being commonly found in concentration of 150 g/ltr of sulfuric acid and 20–30 g/ltr of oxalic acid.

In the above mentioned processes, the rate of formation of the layer with the mentioned types of electrolyte ranges from 0.2 to 0.4 micron per minute, with a layer density of 2.4 to 3.0 g/cc.

Other types of electrolytes are the organic electrolytes used in integral anodizing which, while it is true, give higher growths, also have the disadvantages of greatly increasing the cost of the process due to the high cost of the electrolytes themselves and the high consumption of electric power due to the necessity of applying much higher current densities for the oxidation.

Later, when the electro-color process appeared, practically the same colors were obtained with that process but at a much lower cost.

Although its cost was low, the electrolyte used and with it the process were at a disadvantage because they could not compete with the previous ones with respect to layer thickness, rate of growth, hardness and resistance to abrasion, so that it became necessary to find an electrolyte of high yield or efficiency, good hardness and low dissolving power, and all this at the lowest possible cost.

Another disadvantage of the existing electrolytes is the necessity to use a cooling system, as the reactions involved in them are exothermic and their operating temperature range between 18° to 20° C.

SUMMARY OF THE INVENTION

The present invention remedies the aforesaid and other disadvantages, offering an anodizing process which uses an electrolyte which operates at ambient or higher temperatures, so that the cost of the process with respect to energy consumption and cooling is reduced.

The invention provides an electrolyte which causes a high layer hardness, low dissolving power, low energy consumption, low cost of chemical products and high rate of growth to be able to work at ambient or higher temperature, increasing the productivity of the baths without detriment to the quality of the oxide produced, all this at a considerably lower cost in relation to the anodizing process and electrolytes known in the art.

Accordingly, it is an object of the invention to provide anodic oxidation of aluminum by means of an electrolyte of low dissolving power.

For an understanding of the principles of the invention, reference is made to the following description of a typical embodiment thereof as illustrated in the accompanying drawings.

GENERAL DESCRIPTION OF THE PREFERRED EMBODIMENTS

Figure 1:
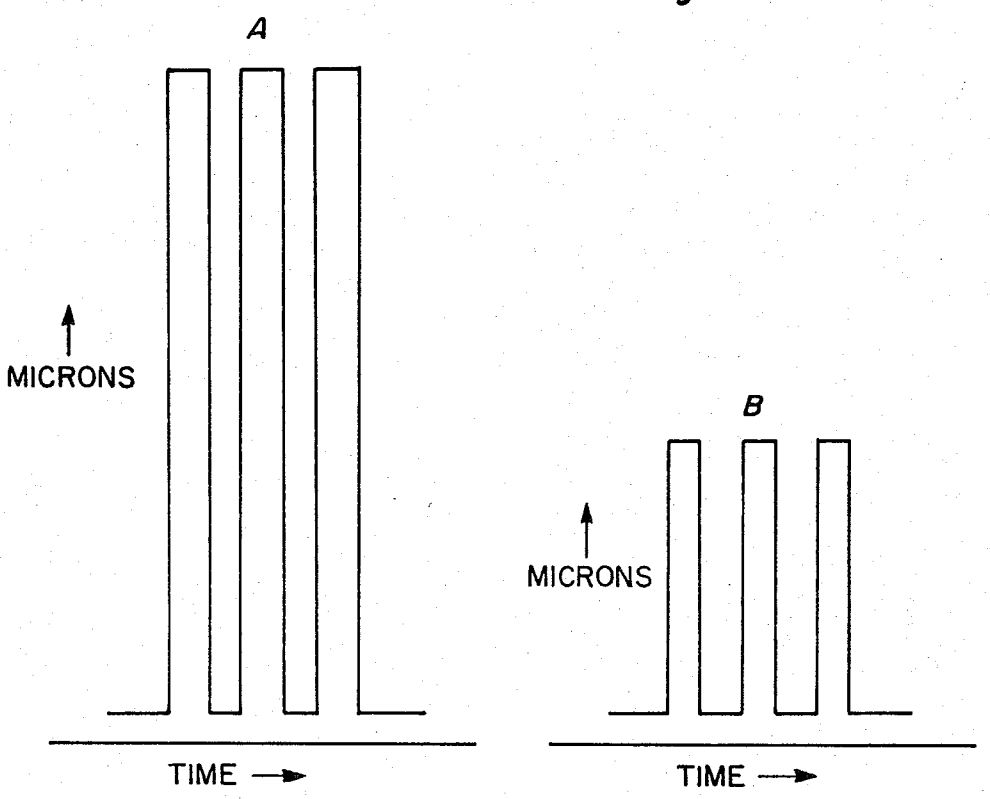
FIG. 1 shows a comparative graph of the growth or result obtained with the process of the invention in 30 minutes and with a conventional process during the same time.

In accordance with the invention, an anodizing process or an anodic oxidation of aluminum is effected by means of an electrolyte of low dissolving power.

The anodizing process of the present invention comprises preparing an electrolyte on the basis of a solution containing a low concentration of sulfuric acid, which may be in the range of 50–250 g/ltr, and booster agent such as a compound selected from among boric acid, glyoxal, ethylene glycol, propylene glycol, glycerin and triethanolamine.

The booster agent acts favorably by reinforcing both the layer formed and its growth, and it has been found that triethanolamine is advantageously suitable as a booster agent, being used in concentrations of 0.1–20 g/ltr.

To the solution of sulfuric acid and booster agent are added 0.1 to 40 g/ltr of formaldehyde and 0.1–10 g/ltr of oxalic acid in order thus to form an electrolyte of notably improved characteristics. Glycolic acid can be substituted for the oxalic acid however.

After the above solution has been prepared, the piece in question is treated by applying a current in the range of from 10 to 30 volts DC, AC, or a pulsed current, a square wave current or a combination thereof, until the desired layer is obtained on the treated surface.

It has been found that the process of the present invention gives excellent results within a range of 0–100 g/ltr of aluminum dissolved in the electrolyte.

The temperature of the process varies between 25° and 45° C., thereby reducing the energy consumption for refrigeration.

Because the time within which the oxide layer is obtained is notably reduced by the process of the present invention, the energy consumption decreases considerably also.

For a clearer presentation of the process of the present invention and its advantages and improvements, the experiments made with three parts of aluminum alloy 6063 (commercial) that served as "sample" are cited below in the form of examples.

The three parts were degreased in a sodium hydroxide solution whose concentration was 40 g/ltr, rinsed and neutralized in a 20% sulfuric acid solution, each being subjected to electrolytic oxidation under the following conditions:

EXAMPLE I—CONVENTIONAL PROCESS

The electrolyte was prepared with 165 g/ltr sulfuric acid and a current of 1.2 amperes/dm$^2$, 17 volts, DC was applied, the temperature being maintained (through an appropriate cooling system) at 20° C., these conditions being maintained for 30 minutes.

EXAMPLE II—CONVENTIONAL PROCESS

The sample to be coated was treated with an electrolyte formed by 150 g/ltr sulfuric acid and 30 g/ltr oxalic acid, applying a current of 1.2 amp/dm$^2$, 17 volts DC and maintaining a temperature of 25° C., all this for 30 minutes.

EXAMPLE III—PROCESS OF THE INVENTION

The third piece to be treated was exposed to a current of 1.2 amp/dm$^2$, 17 volts DC, in an electrolyte formed by a solution of 130 g/ltr sulfuric acid, 1 g/ltr oxalic acid, 5 g/ltr formaldehyde and 5 g/ltr triethanolamine, the process being carried out at 32° C., for 30 minutes.

The results obtained are shown in the following table.

TABLE I

| Example No. | Layer Thickness (Microns) | Hardness |
|---|---|---|
| I | 9.5 | Medium |
| II | 12.0 | Good |
| III | 21.0 | Excellent. |

From the results obtained, which are charted in FIG. 1, it can easily be seen that with the process of the present invention a much greater layer thickness(A) is obtained, caused by an increase in the rate of formation of more than 200%, and of no less importance is the fact of obtaining a layer of a hardness also superior, by comparison with the samples treated with the process of the prior art (B).

It should be noted that with the conventional processes using formaldehyde, although one can operate at ambient temperature, when reaching 30° C. the quality of the layer is very poor, and in addition considerable environmental contamination is caused due to the formaldehyde released.

Figure 3:
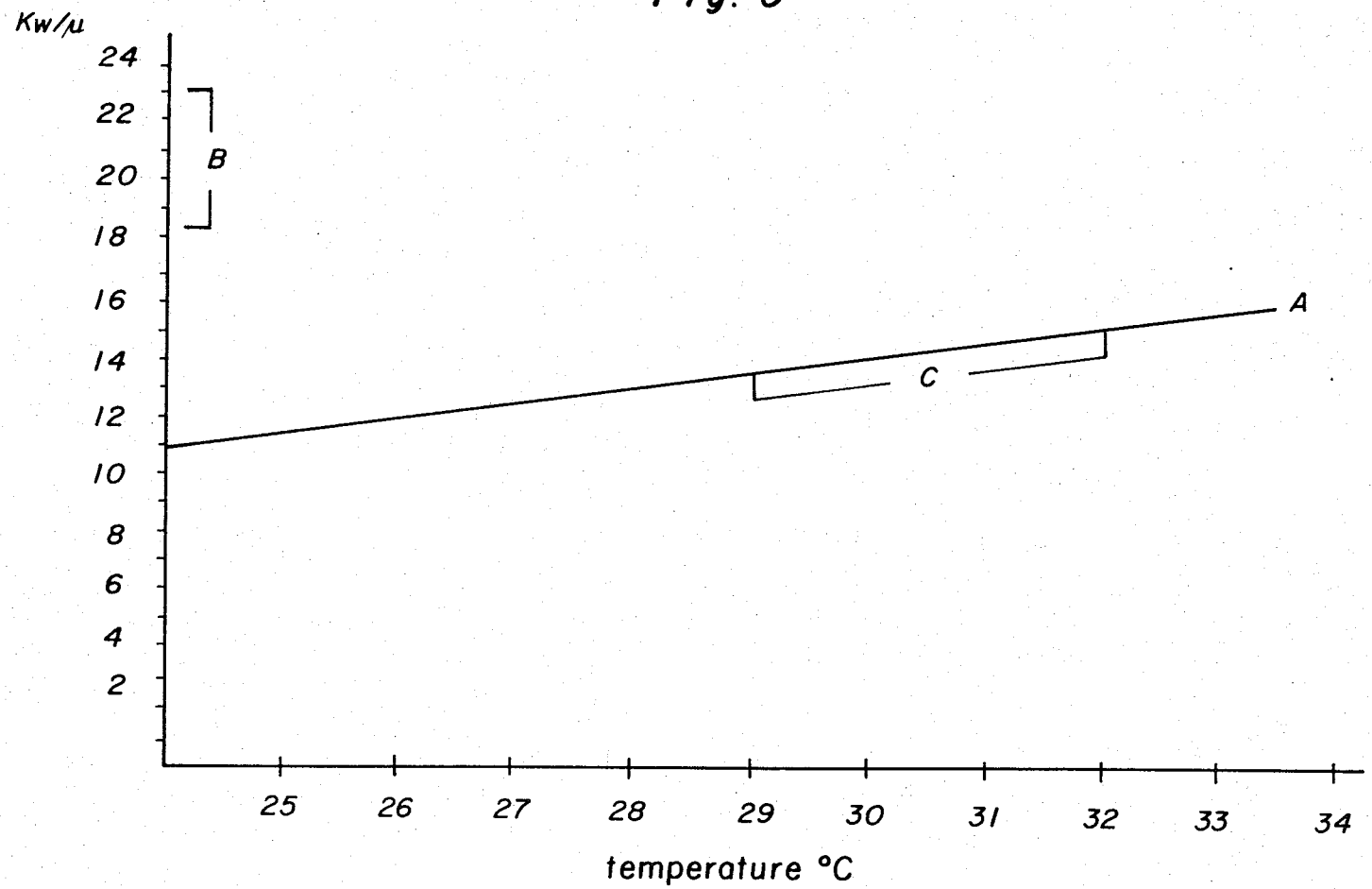
FIG. 3 is a graph which illustrates the energy consumption versus time, showing the low energy consumption necessary with the anodizing process of the present invention, by comparison with a conventional or known process.

The notable difference in energy consumption between the process of the present invention and the process of the prior art can easily be seen in FIG. 3, where it is noted that a substantial saving of energy is obtained when working with the process of the present invention (curve A), by comparison with the energy consumption of the conventional process (zone B), bringing out the idea zone C in which the optimum operating conditions and a layer of improved qualities are obtained.

Figure 2:
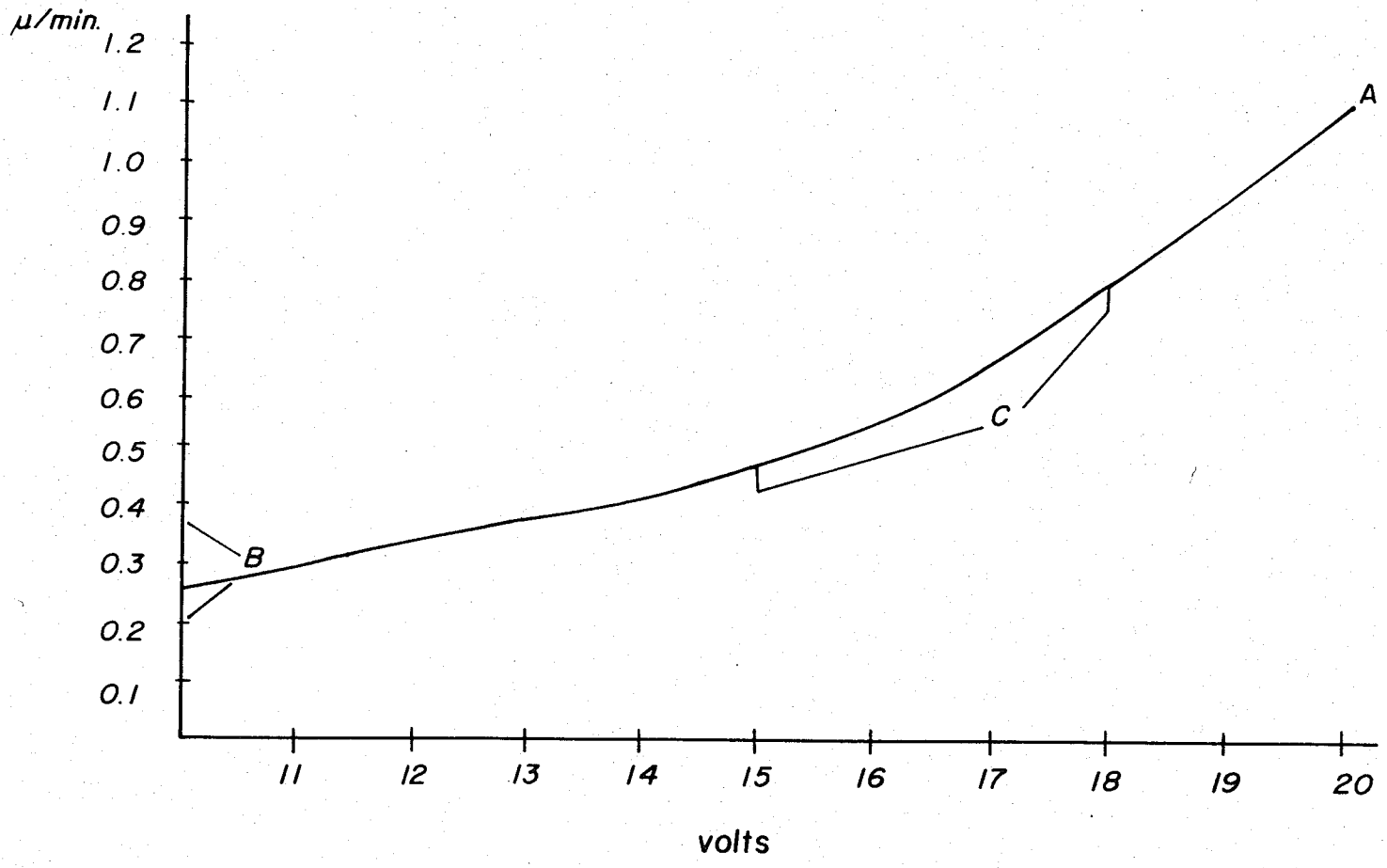
FIG. 2 illustrates a graph of rate of growth versus voltage, comparing the efficiency of the present invention with a conventional process.

The growth or rate of formation of the layer as a function of the voltage applied, for the process of the present invention and the conventional process, is represented in FIG. 2, where it can be observed that with the process of the invention in question (curve A) a layer growth superior to the conventional process (zone B) is obtained. Zone C of FIG. 2 indicates the ideal conditions for obtaining a layer of excellent quality.

In short, the process of the present invention offers a considerable saving in the consumption of energy, as the rate of formation of the layer is superior to that of the conventional processes, so that less energy is required to obtain a good layer. Besides, because the process is carried out at ambient or higher temperatures, the energy consumption for the cooling system has been reduced substantially.

On the other hand, the cost of the process is also reduced in relation to the consumption of raw materials since, for example, the conventional processes use sulfuric acid in a concentration of 165–240 g/ltr, while the present invention uses a concentration of 60–250, and preferably between 100 and 150 g/ltr.

The low sulfuric acid concentration which the process of the present invention uses not only represents a saving in the cost thereof, but also the acid is inhibited, dissolving less oxide, therefore requiring a smaller acid consumption, as a result of the reduction of its dissolving power.

Besides, the sulfuric acid being inhibited, the problem of corrosion existing in all plants that use the anodizing process of the prior art is eliminated or at least considerably diminished, this fact being refleted in a significant saving in the purchase of special corrosion-resistant equipment, as well as in the maintenance thereof, and not less important is the fact that with the process of the invention a longer useful life of the equipment is obtained.

Although the present invention has been described and illustrated in accordance with specific developments, these must not be considered limitative, it being evident to those expert in the field that modifications and/or adaptations thereto can be made without going outside its spirit and scope.

While a specifc embodiment of the invention has been shown and described in detail to illustrate the application of the principles of the invention, it will be understood that the invention may be embodied otherwise without departing from such principles.

What is claimed is:

1. An improvement in an anodizing process, of the kind used for the anodic oxidation of aluminum by means of an electrolyte of low dissolving power, comprising preparing an electrolyte on the basis of a sulfuric acid solution of a concentration which varies between 50–250 g/ltr; a booster agent selected from the group consisting of boric acid, glyoxal, triethanolamine, ethylene glycol, propylene glycol and glycerin, in a concentration between 0.1 and 20 g/ltr, oxalic acid in a concentration of 0.1 to 10 g/ltr and formaldehyde with a concentration of 0.1 to 40 g/ltr; and treating the aluminum in question with the electrolyte thus formed, by applying a current at 10–30 volts and at a temperature of 25°–45° C.

2. Improvements according to claim 1, characterized in that the applied current is one of: direct current, alternating current and square wave current.

3. An improvement according to claim 1, wherein the concentration of the sulfuric acid is 100–150 g/ltr and that of formaldehyde is 1 to 10 g/ltr, the booster agent being triethanoalmine with a concentration of 1–5 g/ltr, the concentration of the oxalic acid 0.1–2 g/ltr, the operating temperature 28°–45° C. and the applied voltage 10–20 volts DC.

4. An improvement according to claim 1, wherein the concentration of the sulfuric acid is 100–150 g/ltr, that of the oxalic acid is 1 g/ltr, that of the formaldehyde 5 g/ltr and that of the triethanolamine 1 g/ltr, the operating temperature being 28°–38° C. and the voltage applied 10–18 volts DC.

5. An improvement according to claim 4, wherein the electrolyte is under agitation and its aluminum concentration is in the range from 0 to 30 g/ltr dissolved in it.

6. An improvement according to claim 1, wherein the rate of formation of the layer ranges between 0.35 and 1.2 micron per minute, a voltage of 15–24 volts being applied.

7. An improvement according to claim 1, wherein the energy consumption varies in the range of 2.5–4.0 kW/micron $dm^2$ and the temperature is in the range of 25°–40° C.

8. An improvement in an anodizing process, of the kind used for the anodic oxidation of aluminum by means of an electrolyte of low dissolving power, comprising preparing an electrolyte on the basis of a sulfuric acid solution of a concentration which varies between 50–250 g/ltr; a booster agent selected from the group consisting of boric acid, glyoxal, triethanolamine, ethylene glycol, propylene glycol and glycerin, in a concentration between 0.1 and 20 g/ltr, glycolic acid in a concentration of 0.1 to 10 g/ltr and formaldehyde with a concentration of 0.1 to 40 g/ltr; and treating the aluminum in question with the electrolyte thus formed, by applying a current at 10–30 volts and at a temperature of 25°–45° C.

* * * * *